US006299152B1

(12) United States Patent
Sangmeister et al.

(10) Patent No.: US 6,299,152 B1
(45) Date of Patent: Oct. 9, 2001

(54) WORKBENCH

(75) Inventors: Gerhard Sangmeister, Weibern; Zbigniew Noniewicz, Kempenich, both of (DE)

(73) Assignee: Wolfcraft GmbH, Kempenich (DE)

( * ) Notice: Subject to any disclaimer, the term of this patent is extended or adjusted under 35 U.S.C. 154(b) by 0 days.

(21) Appl. No.: 09/485,480

(22) PCT Filed: Aug. 5, 1998

(86) PCT No.: PCT/EP98/04874

§ 371 Date: Jun. 5, 2000

§ 102(e) Date: Jun. 5, 2000

(87) PCT Pub. No.: WO99/08840

PCT Pub. Date: Feb. 25, 1999

(30) Foreign Application Priority Data

Aug. 14, 1997 (DE) ..... 197 35 336

(51) Int. Cl.[7] ..... B25B 5/02
(52) U.S. Cl. ..... 269/139; 269/170; 269/171.5
(58) Field of Search ..... 269/139, 104–107, 269/110, 152–156, 79, 81, 237, 166–171.5

(56) References Cited

U.S. PATENT DOCUMENTS

| | | | | |
|---|---|---|---|---|
| 738,055 | * | 9/1903 | Newnam | 269/139 |
| 1,673,381 | * | 6/1928 | Van Berkel | 269/170 |
| 2,424,313 | * | 7/1947 | Heinrich | 269/168 |
| 2,892,369 | | 6/1959 | Millet . | |
| 4,057,239 | * | 11/1977 | Hopf et al. | 269/170 |
| 4,154,435 | | 5/1979 | Alessio . | |
| 4,184,667 | * | 1/1980 | Alessio | 269/139 |

FOREIGN PATENT DOCUMENTS

| | | |
|---|---|---|
| 156719 | 9/1921 | (CH) . |
| 39 17 473 | 2/1990 | (DE) . |
| 44 18 687 | 7/1996 | (DE) . |
| 44 18 688 | 10/1996 | (DE) . |
| 0 520 396 | 12/1992 | (EP) . |
| 195618 | 4/1924 | (GB) . |
| WO 91/08865 | 6/1991 | (WO) . |
| WO 92/14581 | 9/1992 | (WO) . |
| WO 93/04820 | 3/1993 | (WO) . |

* cited by examiner

*Primary Examiner*—Robert C. Watson
(74) *Attorney, Agent, or Firm*—Schiff Hardin & Waite

(57) ABSTRACT

A work bench has a pair of clamping jaws supported on parallel spaced apart beams. At least one of the jaws moves toward the other by means of driving members that are associated with each beam. Each of the driving members for the at least one movable jaw is capable of being individually actuated. The driving members include a step-by-step or ratchet drive constructed and arranged so that each of the drive members can be individually actuated or actuated in unison with one foot of a user via a double-lever construction. The workbench enables hands-free actuating and clamping of both symmetric or prismatic and asymmetric or non-prismatic parts and components.

15 Claims, 8 Drawing Sheets

1
4
21 8 9 34 7 29 25 2
70
3
5
III
III
35 25
52
6
56
57
30
57
58
35 34 25
5
21 8 9 7 29 25 2
II 1
23 24 8 25 29 28 26 7 30 32 3
4
71
71
70
2
5
6
9
19
12
21
13 44 35 34 27 33
11
51
10
20
56
b
55
57
52
58
a
53
54

1
3
30
2
7
8
25
6
25
29
33
28
71
34
63
9
44
35
38
37
46
11

WORKBENCH

BACKGROUND OF THE INVENTION

The invention relates to a workbench having clamping jaws which rest on two parallel beams and of which at least one can be displaced in the direction of the other clamping jaw by means of drive members which are associated with each beam and can be operated individually.

Workbenches of this type are known in various design forms. Thus, for example, in DE-C2 44 18 687 and DE-C2-44 18 688, a fold-up workbench having two clamping jaws is described. One clamping jaw can be moved along the beams by means of two spindle drives which can be operated by a hand crank.

The content of these German patent references is hereby incorporated by reference herein.

One problem is known for these types of workbenches. It is difficult to provide a hands-free operation workbench that also would be capable of clamping non-prismatic workpieces.

SUMMARY OF THE INVENTION

This problem is first solved by providing a workbench constructed in accordance with the present invention. In that regard, one object of the present invention is to provide a workbench that permits hands-free operation and yet ensures the capability of clamping non-prismatic workpieces. In one embodiment, a workbench of the present invention has at least a pair of clamping jaws that rest on two parallel beams wherein one of the clamping jaws can be displaced in the direction of the other clamping jaw by drive members associated with each beam. The drive members can be operated individually or simultaneously. The drive members each have a drive which can be operated step by step and can be operated together or individually with one foot of an operator by a double lever technique. As a result of this configuration, the clamping of workpieces can be carried out in the simplest manner with the hands of an operator free. The workpiece can therefore be held by the operator in the position in which it is to be clamped. The displaceable clamping jaw is moved in the direction of the other clamping jaw by means of a foot operation. By the arrangement of a foot-operable double lever construction the drive members of each beam for the displaceable clamping jaw can be operated individually, which also makes it possible to clamp nonprismatic workpieces. For this purpose, the double lever is formed such that each individual lever can be operated in order to operate a drive member for the clamping jaw, and both drive members can also be operated at the same time, for uniform parallel displacement of the clamping jaws.

In one embodiment, the drive has a pulling or pushing rod that is secured to the clamping jaw and that can be displaced step by step or incrementally by a latching or clamping portion that in turn can be displaced by a pedal. A clamping or latching drive for the displaceable clamping jaw is thus provided, such as is known, for example, from cartridge pressure-emptying devices. By means of foot-operation of one or both foot levers of the double lever, the pulling or pushing rod is displaced step by step by latching or clamping portions in the direction of the clamping position of the workpiece.

In one embodiment, the clamping or latching drive further includes a releasable reverse-pressure lock. The latter can also be formed as a latching or clamping portion. In order to release the clamping position again, this reverse-pressure lock can be released, after which the clamping jaw can be displaced back again in the direction of the original position.

In one embodiment, the reverse-pressure lock is releasable by a reverse pedal operation. Provision is therefore made, for example, for a forward displacement of the clamping jaw into the clamping position to be achieved by pressing down the pedal or both pedals, and for release of the reverse-pressure lock to be achieved by lifting the pedal. Thus, both the clamping and the releasing of the workpiece after it has been worked on can be carried out with the hands free.

In one embodiment, the latching or clamping portion is further displaceable by an operating lever. In one embodiment, the operating lever is coupled to the pedal by a drive rod. In this case, preference is given to an arrangement in which an operating lever which is connected to a pedal by way of a drive rod is associated with each drive of the clamping jaw. In order to displace the pulling or pushing rod, the respective operating lever can be connected, for example in a pivotable manner, to the latching or clamping portion. However, it is also conceivable to act on the latching or clamping portion merely by means of the operating lever and, in this way, to achieve a displacement.

In one embodiment, the operating lever enters into a driver opening in a locking portion to release the reverse-pressure lock. By means of an appropriate displacement of the operating lever—as already mentioned, preferably by means of a reverse pedal operation—the locking piece is dragged along by way of the driver opening in such a way that this locking portion is pivoted or displaced into a position which releases the pulling or pushing rod. After this, the clamped workpiece is released. Furthermore, when the reverse-pressure lock is released, the clamping jaw can be displaced back again.

In one embodiment, the double pedal is disposed approximately at the center of a cross-member of the workbench. It proves to be particularly advantageous in terms of operation for the double pedal to be shaped like a gateway. By pressing down one or both pedals by means of foot operation, the clamping jaw is displaced forwards, as described. In order to release the reverse-pressure lock as a result of a reverse pedal operation, the foot passes through the double-pedal gateway and acts on the underside of the pedals by pulling the pedals. In one embodiment the drive rod and be pivoted in each case on a pivoting lever, the lever being mounted on a shaft which can be rotated by the foot pedal. The lever is disposed in the region of a supporting leg and extends in the U-shaped space in the supporting leg, which is shaped as a U-section. The drive rods coupled to the operating levers of the respective drives are thus located in a hidden position within the U-shaped spaces in the supporting legs. In one embodiment the clamping or latching drive is disposed approximately at the centre of the beam, underneath a bottom sliding bearing formed by a U-shaped beam section.

In one embodiment, the other clamping jaw can be mounted on the beams so that it can be moved by a spindle. This provides greater variability in the clamping area. In this case, this clamping jaw can be moved in a known manner along the beams in the direction of the one clamping jaw by means of two spindle drives which can be operated by a hand crank. In this case, it proves to be particularly advantageous for a beam section carrying the other clamping jaw to be capable of being pivoted up into a 90° position. This 90° position of the other clamping jaw can preferably be achieved only when the one clamping jaw is displaced completely back. In one embodiment, the other clamping jaw, when in the pivoted-up position, can be engaged against the broad face of the foot-operated clamping jaw. It is therefore possible for workpieces to be clamped vertically as well, for example in order to work on the sides thereof. In this case, clamping is carried out by means of the above-described spindle displacement of the pivoted-up clamping jaw.

The inventive features described are preferably provided on a fold-up workbench, such as is used in particular in the do-it-yourself sector. In this respect, it is proposed to make it possible for the supporting legs of the workbench to be folded into a position parallel to the beams and, in the position of use, to be locked to the beams. However, suitable configurations on professional workbenches are also conceivable.

BRIEF DESCRIPTION OF THE DRAWINGS

The invention is explained in more detail below with reference to the accompanying drawings, which illustrate only an exemplary embodiment and in which.

DETAILED DESCRIPTION OF THE PREFERRED EMBODIMENTS

Figure 1:
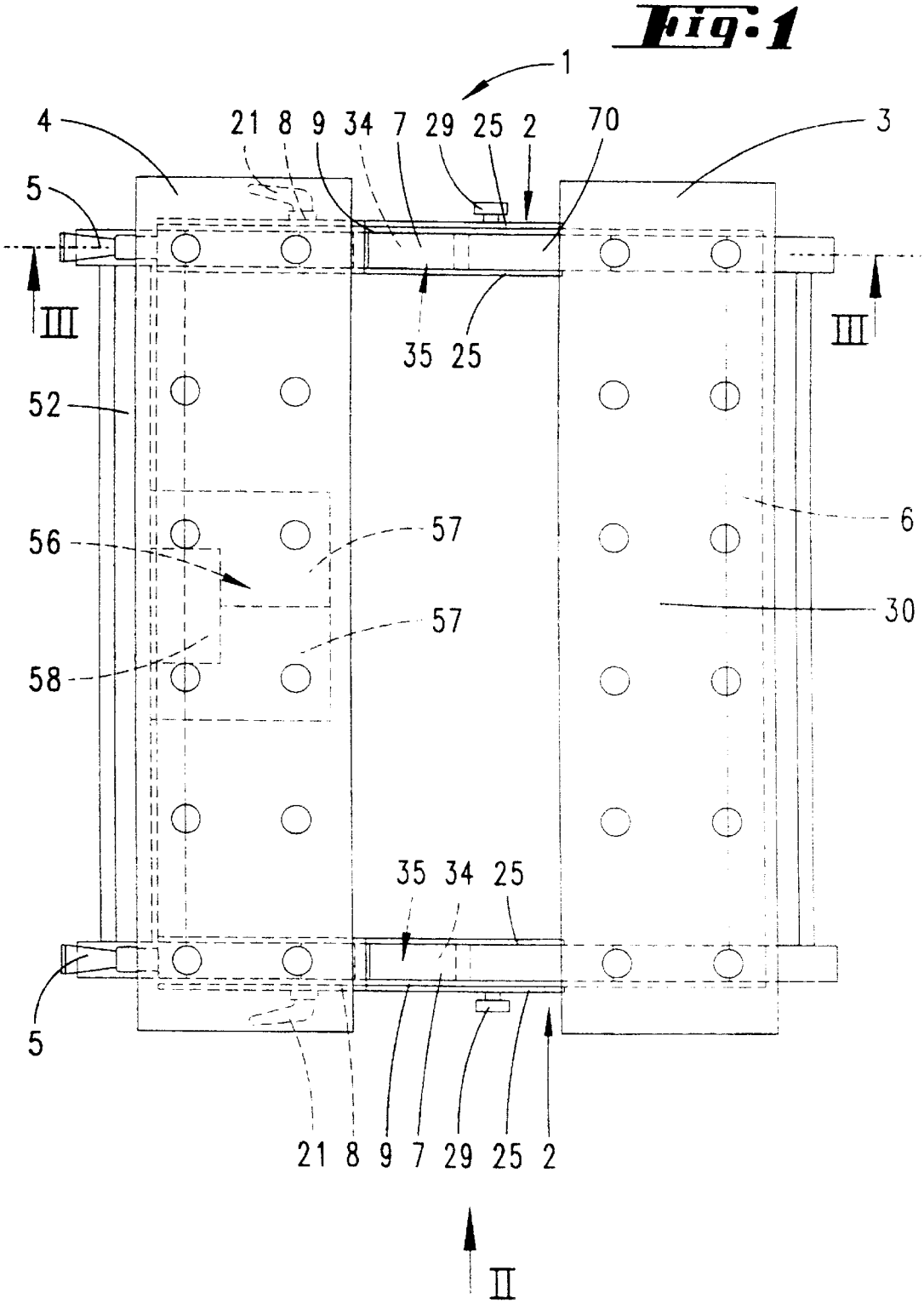
FIG. 1 shows a plan view of a workbench according to the invention.
Figure 2:
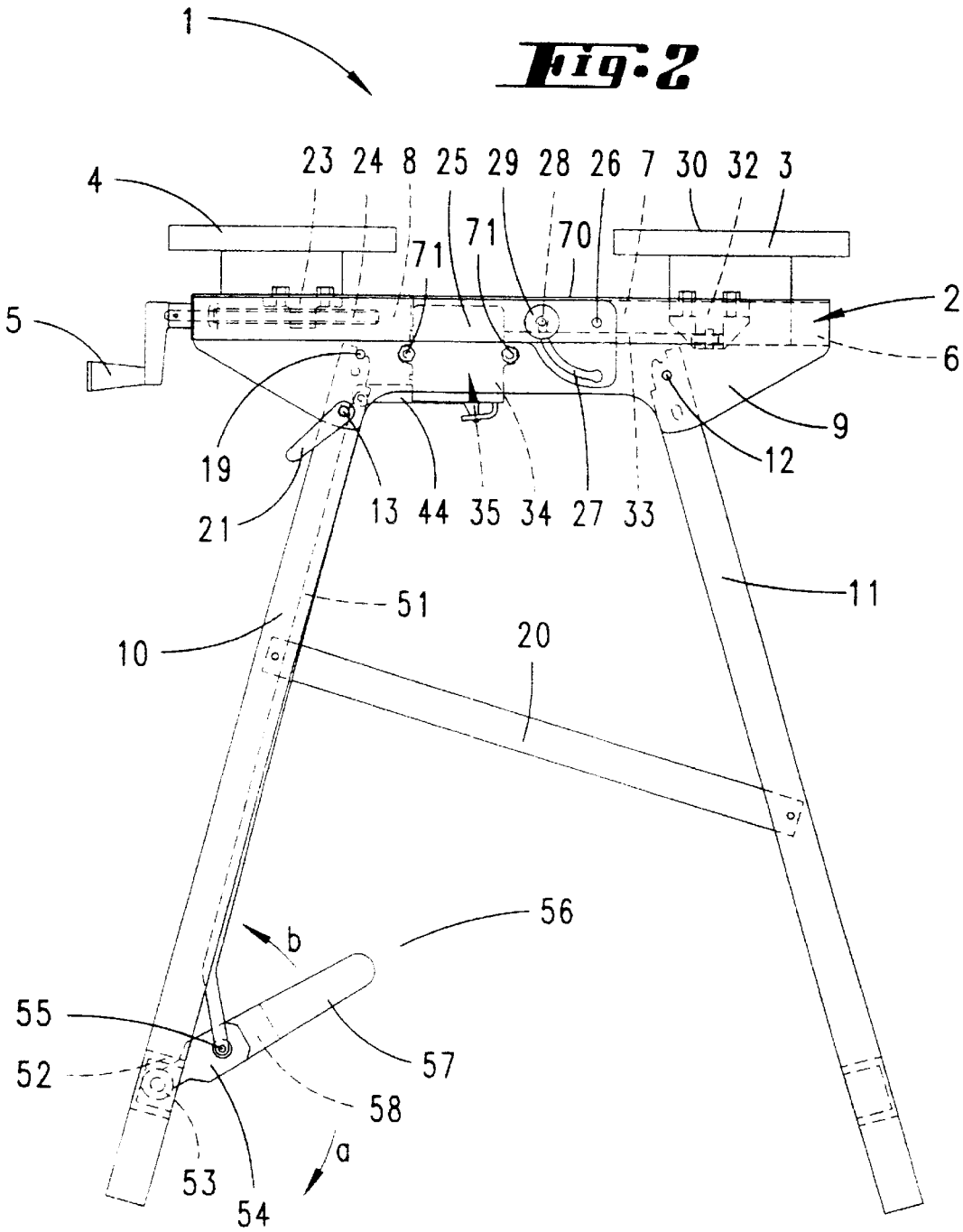
FIG. 2 shows a view according to the arrow II in FIG. 1.
Figure 3:
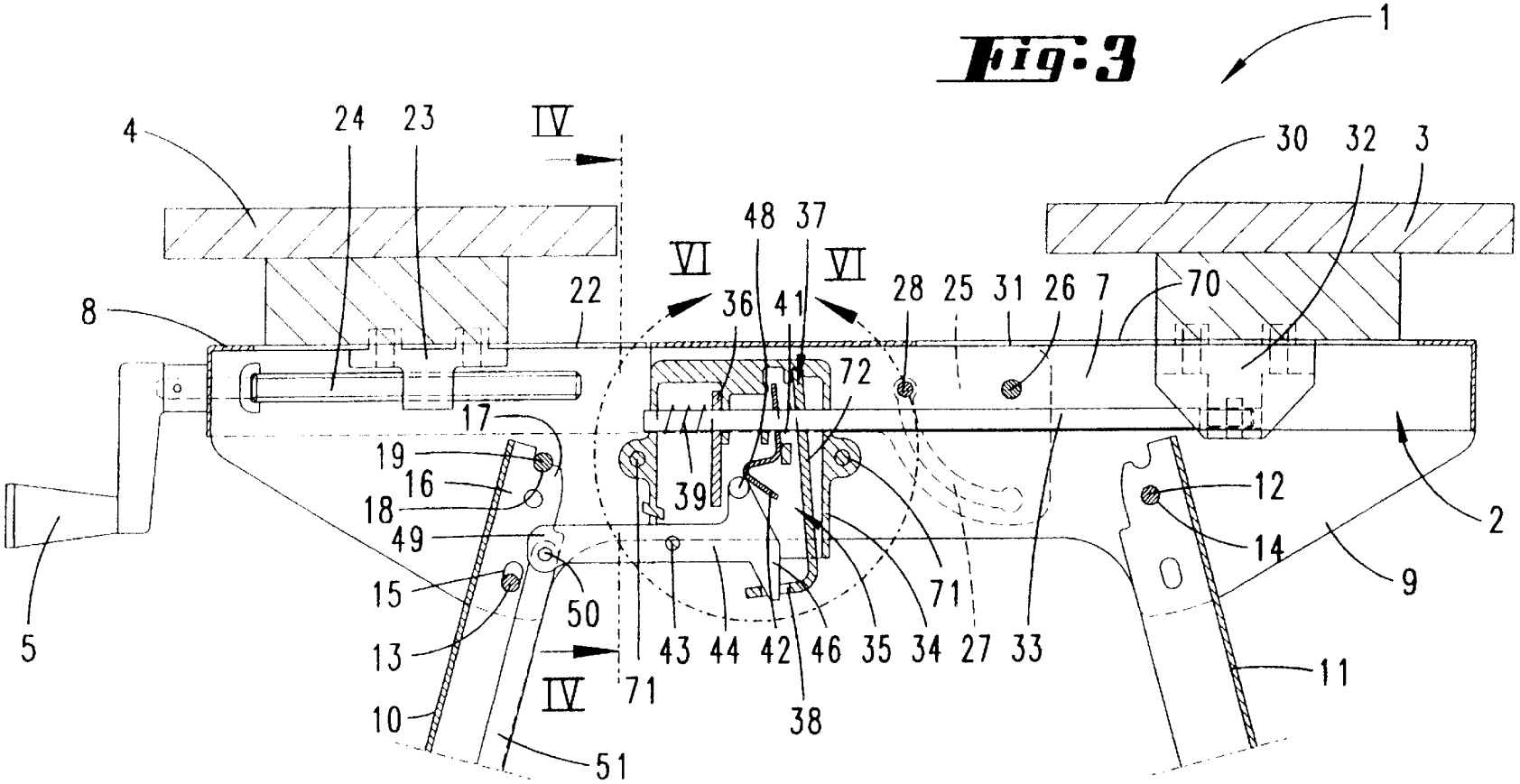
FIG. 3 shows the section along the line III—III in FIG. 1.
Figure 4:
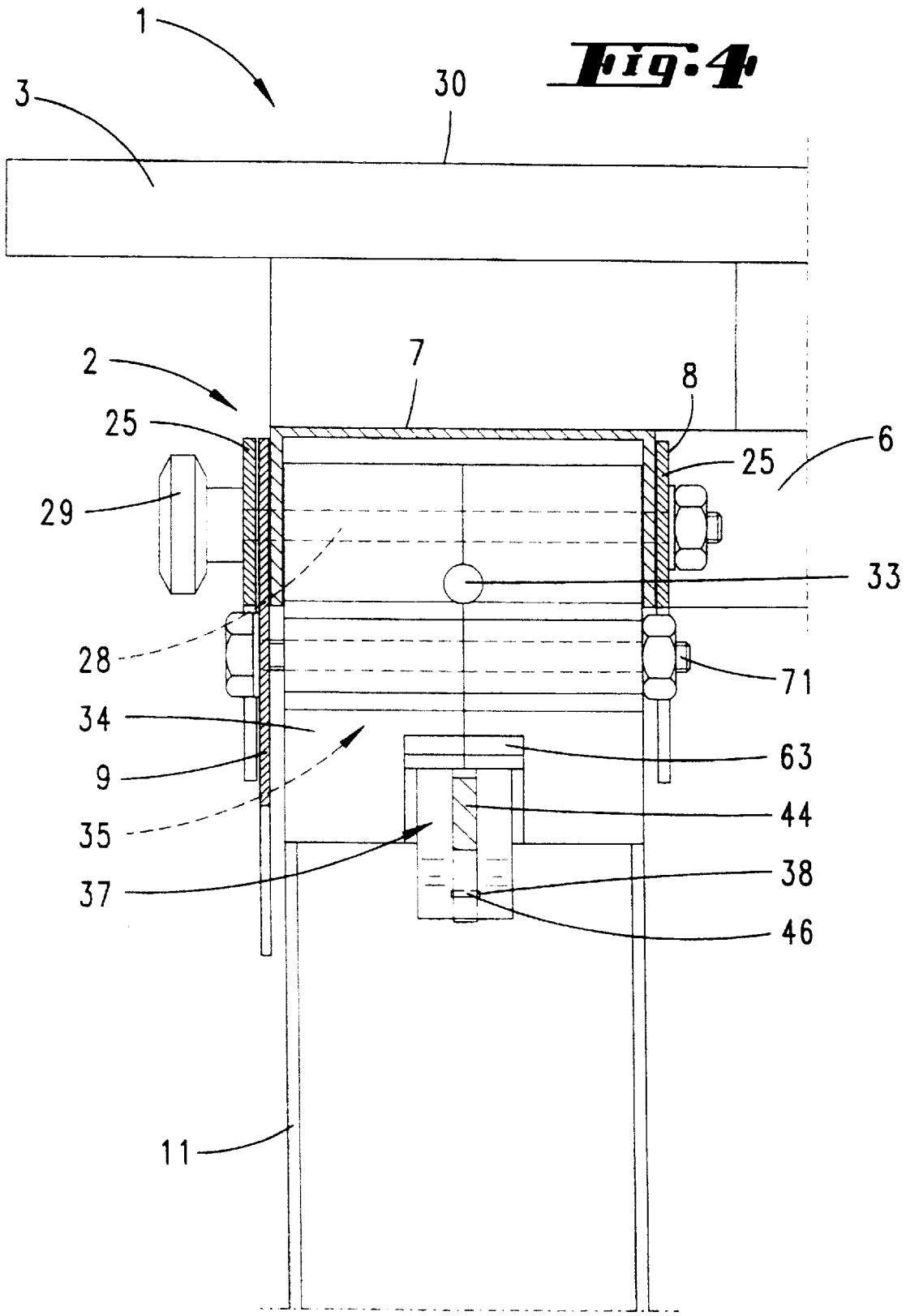
FIG. 4 shows the section along the line IV—IV in FIG. 3.
Figure 5:
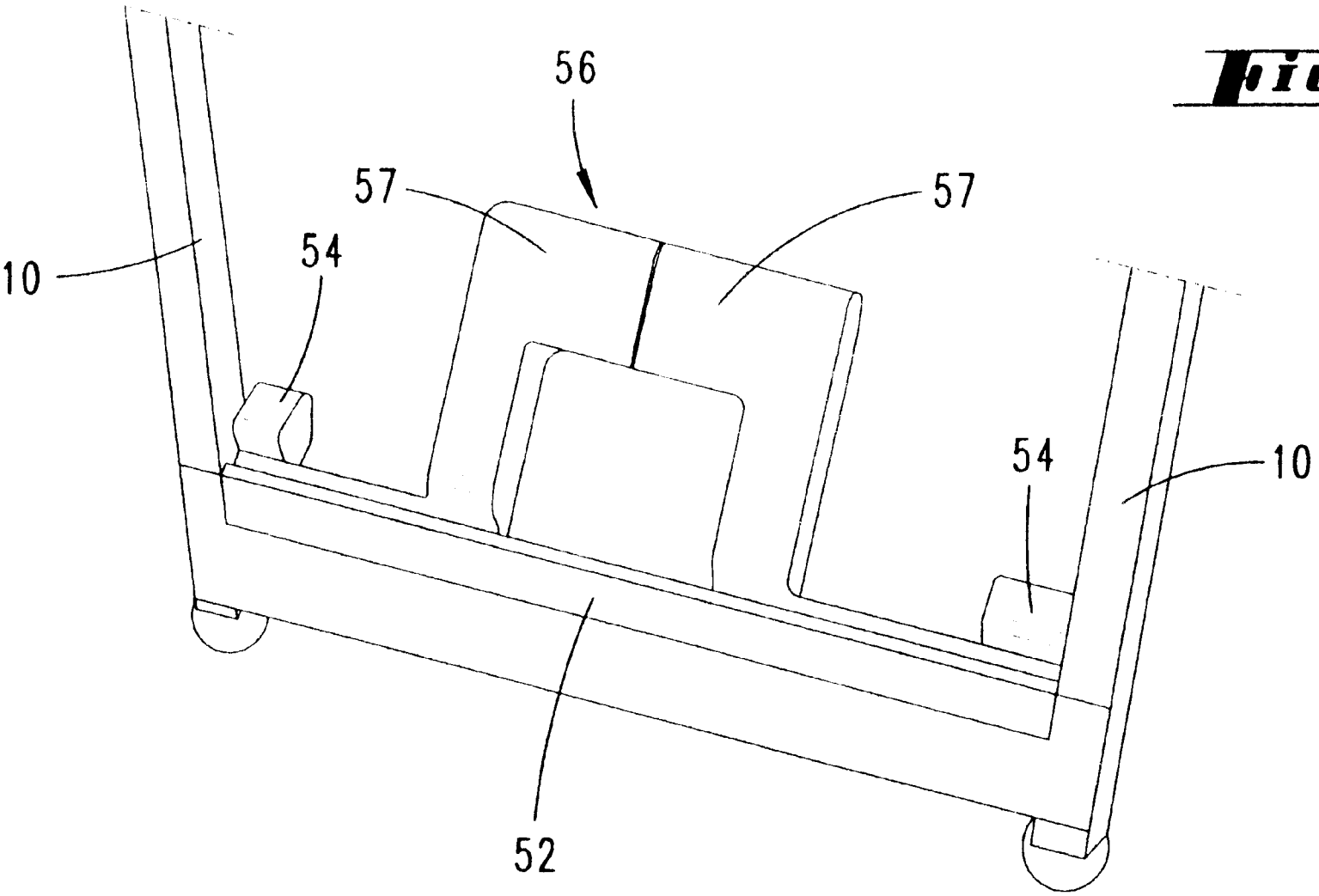
FIG. 5 shows perspective detailed illustration showing the area of a double pedal for operation of drive members of a clamping jaw.

Illustrated and described first with reference to FIGS. 1 and 2, is a workbench 1 formed as a clamping bench and having two clamping jaws 3, 4 resting on two parallel beams 2.

The left-hand clamping jaw 4 illustrated in FIGS. 1 and 2 can be moved along the beams 2 in a known manner by two spindle drives which can be operated by means of hand cranks 5.

At their ends opposite the hand cranks 5, the two beams 2 are connected to each other by a transverse beam 6. In addition, the two beams 2 have a U-shaped cross section which is downwardly open, the web of the U-shaped sections forming a sliding bearing surface 70.

The longitudinal extent of the two beams 2 is subdivided into a stationary beam section 7 and a beam section 8. In a basic position according to FIGS. 1 and 2, the beam section 8 forms an extension of this stationary beam section 7 and is pivotably secured to the stationary section. The beam section 8 carries the spindle-driven clamping jaw 4. The two beam sections 7 and 8 are formed to be of approximately the same length.

In order to form a stationary top frame, in each case on the outside of each stationary beam section 7, there are attached sheet-metal cheeks 9 extending over the entire length of the beams 2. At the top, these sheet-metal cheeks terminate flush with the surface of each web of the stationary U-shaped beam sections 7 and, in their region projecting beyond the stationary beam section 7, form a support for the webs of the pivotable U-shaped beam sections 8 in their horizontal alignment.

Two supporting legs 10 and 11 are mounted on each of the sheet-metal cheeks 9. The supporting legs 10 and 11 can be pivoted in order to fold up the workbench 1. The pivotal mounting of the supporting legs is provided in identical manner on both sides of the bench. At its upper end, the leg 11 is mounted such that it can be pivoted about a pivot pin 12, which is supported in the respective sheet-metal cheek 9. The leg 10 is by contrast mounted at a lower pivot point such that it can be pivoted about a pivot pin 13.

The supporting legs 10, 11 each have a U-shaped cross-section and are arranged with the open side of the U-shaped cross-section facing each other. The pivot pins 12, 13 each pass through side walls of the supporting legs 10, 11, the pivot pin 12 being accommodated by a matched, round bearing hole 14, while the pivot pin 13 is accommodated by an elongated hole 15, whose longitudinal axis extends in the longitudinal direction of the supporting leg 10.

The supporting leg 10 has an extension 16, at the upper end of which there is formed a notch or latching hollow 18 provided with a detent step 17. When the bench is fully set up or unfolded according to FIGS. 1 and 2, a latching pin 19 is latched or received into the latching hollow 18, the said pin likewise being supported fixedly in the respective sheet-metal cheek 9.

Each pairing of the supporting legs 10 and 11 on each side of the workbench 1 are interconnected to each other by a coupling rod 20. The coupling 20, the beam assembly 2, and the supporting legs 10 and 11 on each side of the workbench 1 constitute a four-bar linkage. However, the linkage includes an additional degree of freedom because the hole 15 for each pivot pin 13 is an elongate hole.

In order to fold up the workbench 1 from the position according to FIGS. 1 and 2, clamping levers 21 mounted on the pivot pins 13 are released first. By this, locking is released, after which the upper frame can be lifted at its end on the left in FIG. 2. In the process, the latching pin 19 is lifted out of the latching hollow 18 on the bench leg.

In its free end region, which carries the clamping jaw 4, the pivotable beam section is formed to be U-shaped in cross section, with a longitudinal slot 22 extending in the web in the longitudinal extent of the U-shaped beam section 8. Through this there passes a drive member 23 which has a threaded hole in the region of the beam section 8, that is to say within the U-section, to permit passage of a spindle 24 which can be operated by means of the hand crank 5. On the upper side of the beam section 8, the clamping jaw 4 is secured to this drive member 23.

The two side walls 25 of the pivotable U-shaped beam section 8 are extended in order to form frame cheeks. The sidewalls 25 extend on the inside along the stationary beam section 7 and on the outside along the sheet-metal cheek 9. At their free ends, a pivot pin 26 mounted in the stationary beam section 7 passes through these sidewalls 25.

Figure 10:
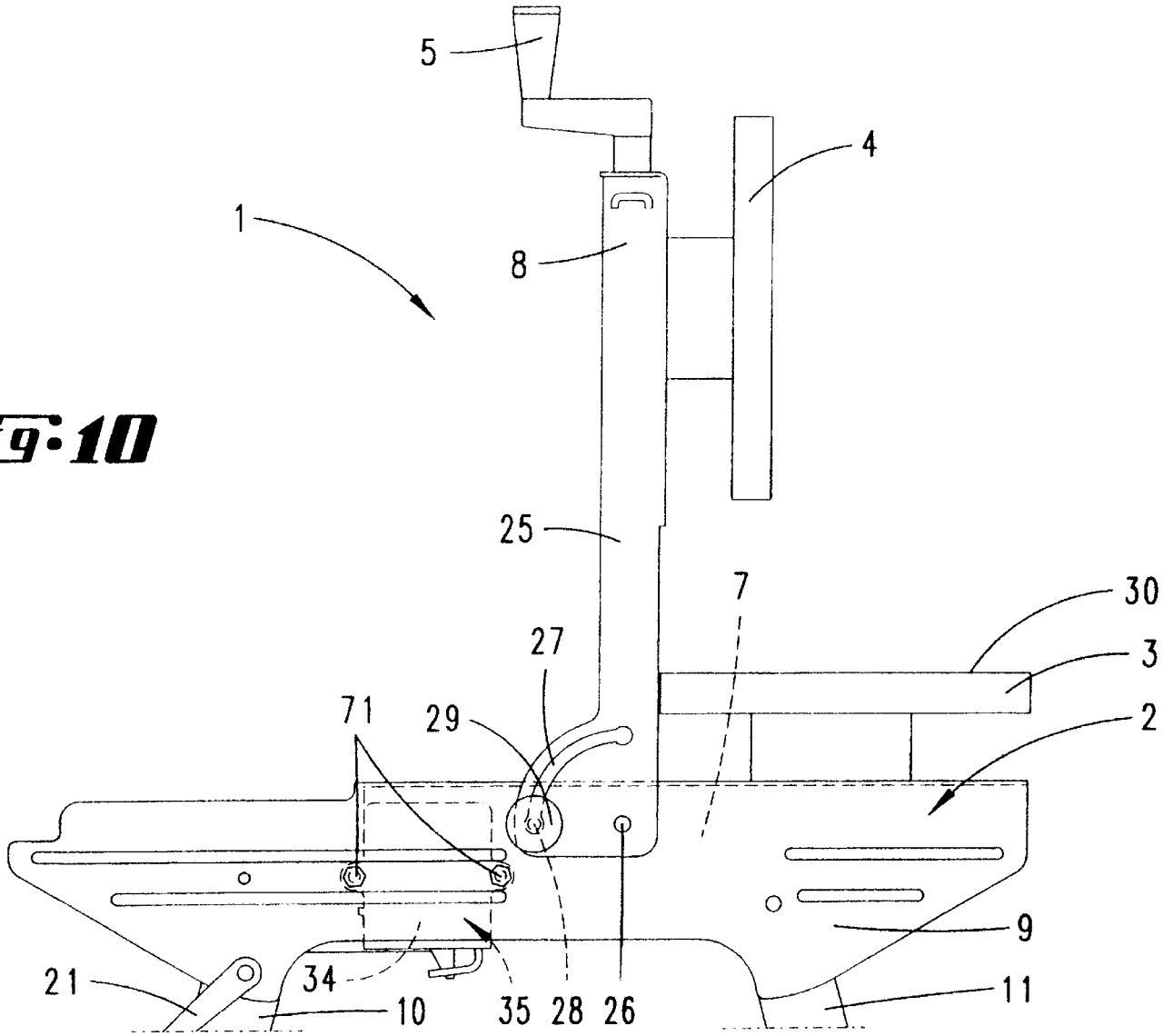
FIG. 10 shows a side view according to FIG. 2, but in a pivoted up 90° position of the other clamping jaw.

A curved slot 27 is formed in an enlarged portion depending from the end region of one of the sidewalls 25 of each of the U-shaped beam sections 8. A stop pin 28 is received through each of the curved slots 27 that is mounted in each stationary beam section 7. A clamping knob 29 is disposed on the outside of this stop pin 28. As a result of this configuration, that beam section 8 which carries the clamping jaw 4 can be pivoted up into a 90° position about the pivot pin 26 and can subsequently be secured by the clamping knob 29. After that, the clamping jaw 4 can be engaged against the broad face 30 of the clamping jaw 3 by way of the spindle drive (see FIG. 10).

In the region of web of the U-shaped, the stationary beam section 7 carrying the clamping jaw 3 also has a longitudinal slot 31, through which there passes a drive member 32 carrying the clamping jaw 3. Within the beam section 7, that is to say in the region of the U-section, the drive member 32 is fixedly connected to a pulling rod 33 extending in the direction of displacement of the clamping jaw 3.

At the end, this pulling rod 33 enters a drive box 34 disposed approximately at the centre of the beam 2 or in the end region of the stationary beam section 7. By means of screws 71, the drive box 34 is secured to the sidewalls of the stationary U-shaped beam section 7.

Accommodated in the drive box 34 is a latching drive 35. The latter is substantially composed of a latching portion 36 interacting with the pulling rod 33 and a locking portion 72 forming a reverse-pressure lock 37. The pulling rod 33, which is provided with a plurality of teeth, passes both through the latching portion 36 and through the locking portion 72. The locking portion 72 is mounted by corresponding web arrangements such that it can be tilted in the drive box 34. The underside of the locking portion 72 emerges from the drive box 34 with a free end bent over in an L shape, the free end having formed therethrough a driver opening 38.

By means of a compression spring 39 which surrounds the pulling rod 33, the latching portion 36 is supported, counter to the direction of displacement of the clamping jaw 3, against a supporting web 40 of the box.

By means of a further compression spring 41, which is supported by a spring element 42, the locking portion 72 is biased into a slightly angled position which locks the pulling rod 33 against any reverse movement by engaging the teeth.

Also disposed in the drive box 34 is an operating lever 44 which is mounted on and can pivot about a pin 43. At one end 49, this operating lever 44 emerges from the drive box 34, passing through a window-like aperture 45. The other end, facing into the drive box 34, is shaped like a hammer head and has, a driving tip 46 which points downwards entering into the driver opening 38 in the locking portion 72. An arm 47 of the operating lever 44 which is directed upward and extends away from this tip 46 has a rounded, preferably pin-like operating projection 48 at its end. This projection bears against the spring element 42 already mentioned, in order to achieve a basic position.

The end 49 of the operating lever 44 which projects freely outwards is connected, by a pivot pin 50, to a drive rod 51 extending in the U-section of the supporting leg 10.

As is to be seen in particular from FIG. 2, each drive rod 51 of each latching drive 35 extends within the associated supporting leg 10, starting from the respective operating lever 44, into a region close to a cross member 52 connecting the two supporting legs 10 to each other. The cross member 52 is likewise formed having a U-shaped cross-section and, in its U-shaped interior, accommodates a rotatable shaft 53 which is divided in two sections over its length.

A pivoting lever 54 is mounted to each section of the shaft 53 in the region of the supporting legs 10. Each pivoting lever 54 projects outward from the U-shaped interior of the cross-member 52 in the direction of the supporting legs 11. Each pivoting lever 54 carries a pivot pin 55 for pivotal connection of the free, slightly bent-out end of the respective drive rod 51.

At the centre of the cross member 52, a double pedal 56 is disposed on the shaft 53, each individual pedal 57 being non-rotatably connected to the respective associated pivoting lever 54 by means of a section of the shaft 53, and it being possible for the two pedals 57 to be operated independently of each other. The result of this is that a pivoting displacement of one pedal 57 has the effect of a simultaneous pivoting displacement of the pivoting lever 54. The double pedal 56 is shaped substantially like a gateway, each individual pedal 57 being L-shaped in plan view and their L-shaped webs pointing towards each other. The gateway formed in this way is provided with the reference numeral 58.

Figure 6:
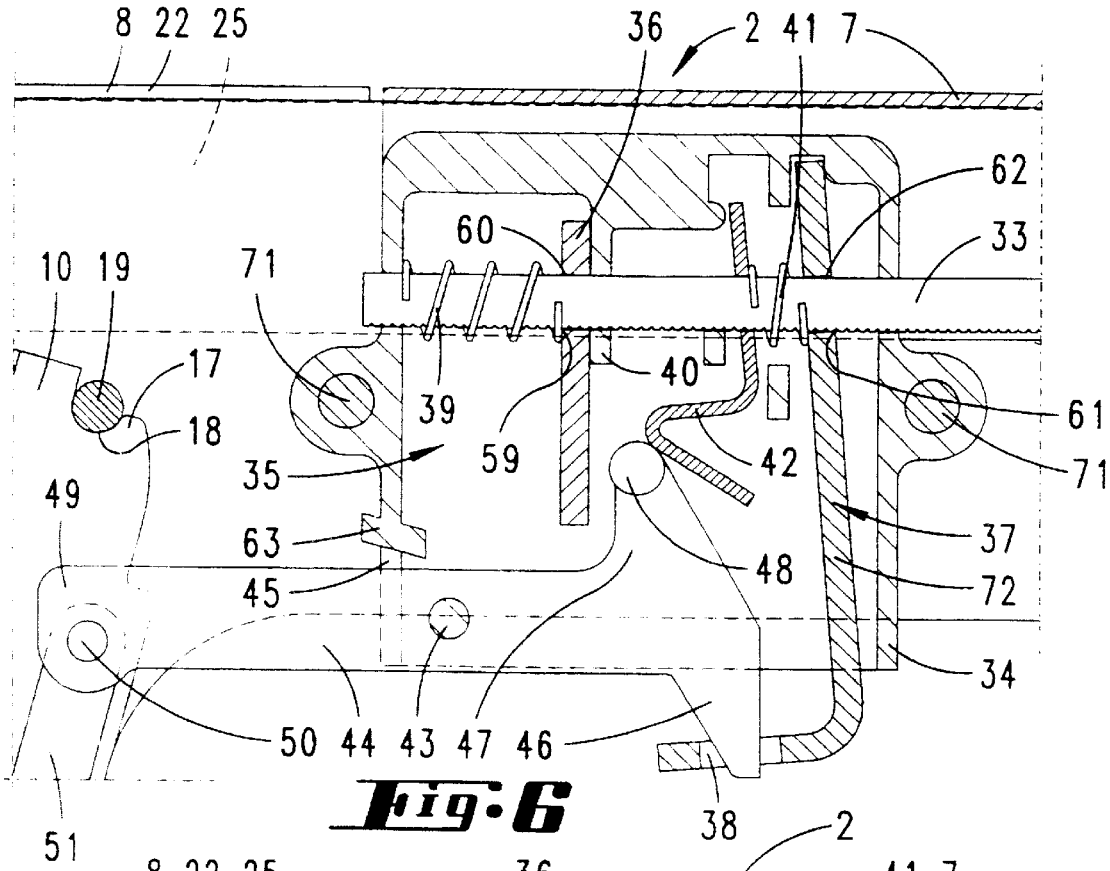
FIG. 6 shows enlarged detail of the region VI—VI in FIG. 3, relating to a rest position of the illustrated drive.
Figure 7:
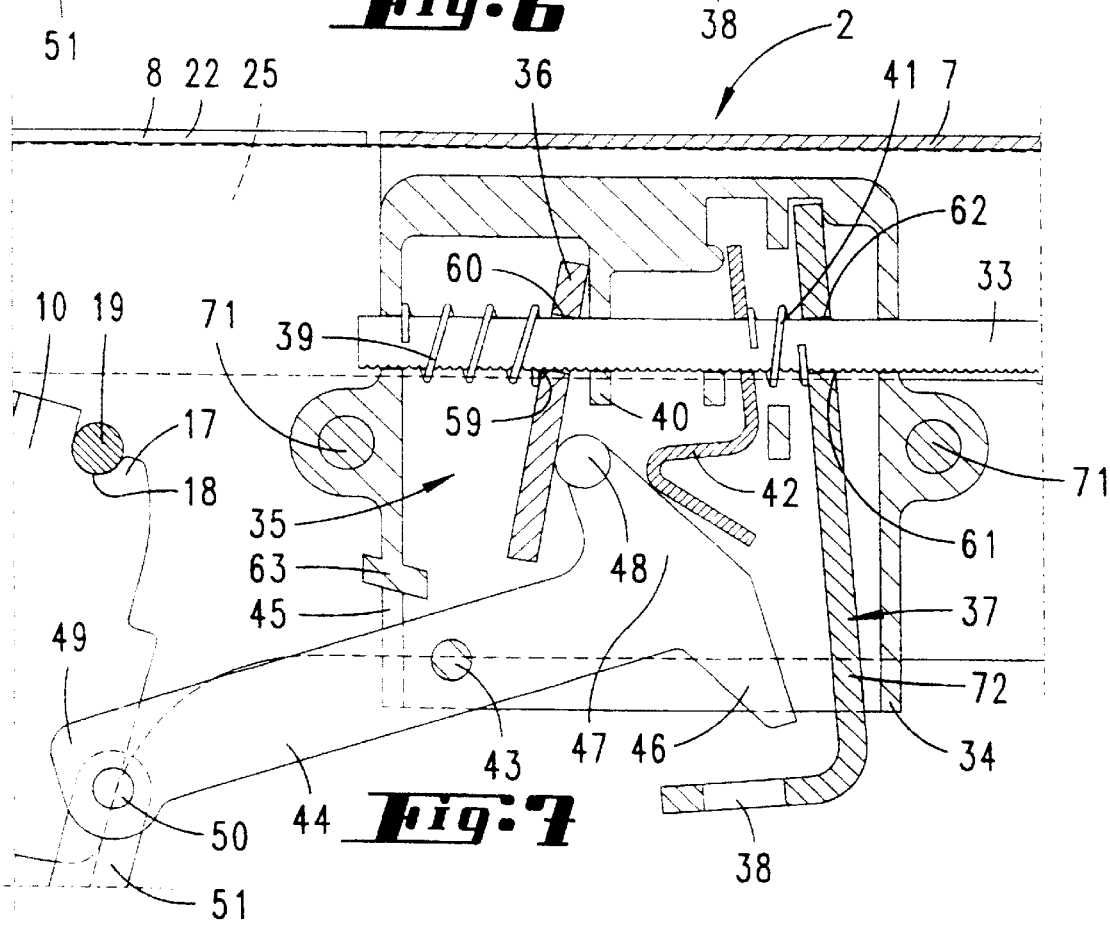
FIG. 7 shows an illustration corresponding to FIG. 6, but during the operation of the drive to displace the one clamping jaw forward.

By means of the configuration described, the drive members 32 of the clamping jaw 3 can be operated together or individually by one foot, step by step such as for example like a ratchet. For this purpose, one pedal 57 or both pedals 57 are pressed down simultaneously by foot operation. This results in a rotational displacement of the pivoting lever 54 according to the arrow a in FIG. 2. The displacement of the latching portion 36 by the operating lever 44 which results from this is illustrated in FIG. 7. As a result of the latching portion 36 being acted on substantially at the end by the operating projection 48 of the operating lever 44, the latching portion 36 is first canted in such a way that the peripheral edge 59 of the hole 60 passing through the pulling rod 33 engages the teeth on the pulling rod 33. A further pivoting displacement of the operating lever 44 as a result of the pedal 57 being pressed down then results in an axial displacement of the latching portion 36, together with the pulling rod 33. At the same time, the clamping jaw 3 is dragged along by the drive member 32 in the direction of the clamping position. If the pedal 57 is released, then the latching portion 36 returns again into the original position according to FIG. 6, because of the spring force of the compression spring 39. At the same time, the latching portion 36 drags the operating lever 44 with it and therefore causes the associated reverse rotational displacement of the operating lever 44. The reverse-pressure lock 37 in this case prevents any reverse displacement of the pulling rod 33, since here the peripheral edge 61 of the hole 62 through which the pulling rod 33 passes engages the teeth on the pulling rod 33 in order to secure it. As a result of repeated pressing on the pedal 57, the pulling rod 33, and therefore the drive member 32 of the clamping jaw 3, is displaced further and further, step by step, in the direction of the desired clamping position.

In addition, the drive shown can also be formed by a clamping portion acting on a pushing rod.

As a result of the double pedal arrangement, it is also possible for nonprismatic workpieces to be clamped, in this case the clamping jaw 3 being displaced along the one or the other beam 2, more or less in the direction of the clamping jaw 4, by operation of the one or the other pedal 57. Furthermore, the dual pedal arrangement also permits a uniform, parallel displacement of the clamping jaw 3 to be carried out, this being done by means of operating the pedals 57 together.

If the clamping jaw 3 is displaced forwards only on one side, that is to say along only one beam 2, by means of a pedal 57 in order to clamp a small workpiece, then a clamping force on the workpiece is aided by the reverse-pressure lock 37 of the clamping jaw 3 in the region of the other beam 2. Accordingly, the clamping jaw 3 cannot yield in the reverse direction in the region of the other beam 2. On the other hand, slight concomitant dragging in the clamping direction is further provided, the pulling rod 33 travelling over the associated latching portion 36 in the manner of a ratchet.

Figure 8:
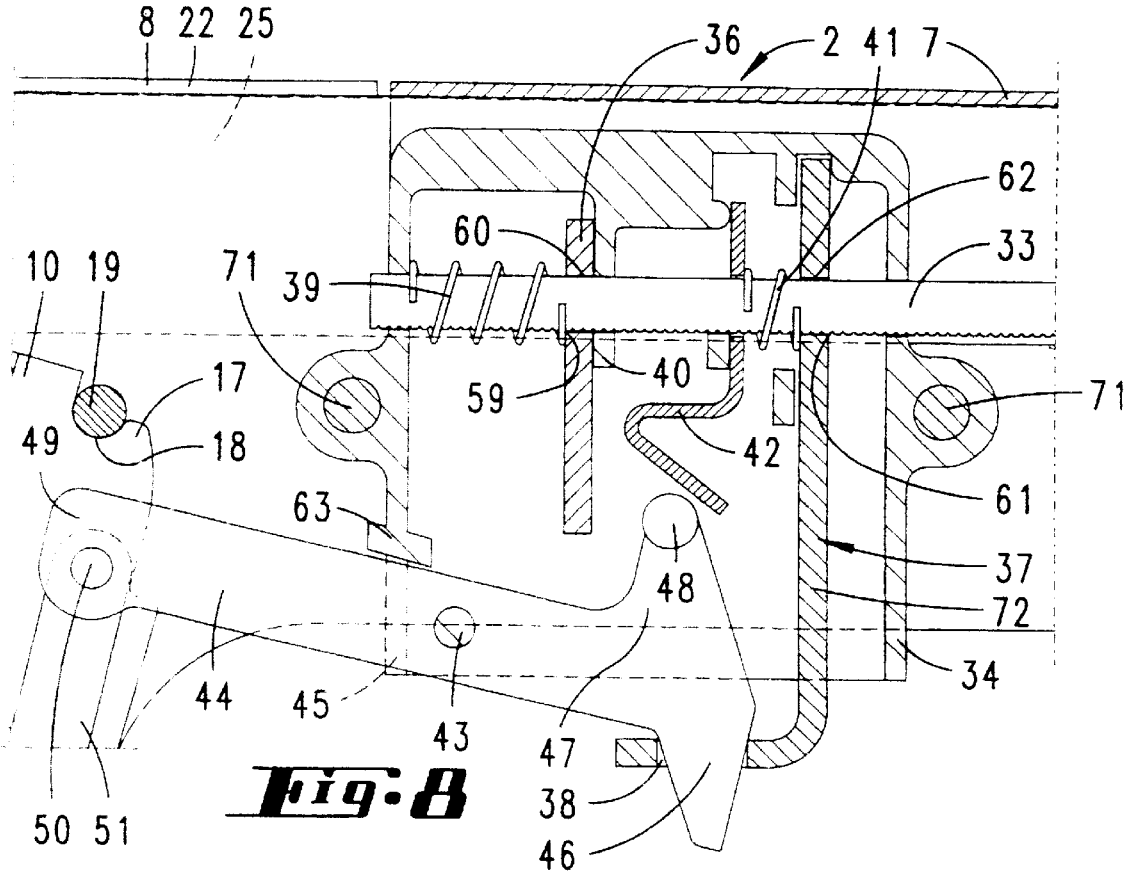
FIG. 8 shows a further illustration corresponding to FIG. 6, but at the time the drive is released for return displacement of the one clamping jaw.

In order to displace the clamping jaw 3 back again, the reverse-pressure lock 37 has to be released. For this purpose, the double pedal 56 or each individual pedal 57 is operated in reverse, that is to say is pulled. This is achieved in the simplest way by the foot passing through the gateway 58 and acting on each individual pedal 57 or both pedals 57 at the same time from below, which results in a rotational displacement of the pivoting lever 54 in accordance with the arrow b in FIG. 2. As FIG. 8 illustrates, this leads to a pivoting displacement of the locking portion 72 by its being driven by the driving tip 46 of the operating lever 44. The peripheral edge 61 of the hole 62 is here displaced out of engagement with the teeth of the pulling rod 33, and thus releases the latter for return displacement of the clamping jaw 3.

The reverse rotational displacement of the operating lever 44 in order to release the reverse-pressure lever 37 is limited by a stop 63 in the region of the aperture 45 in the drive box 34.

Figure 9:
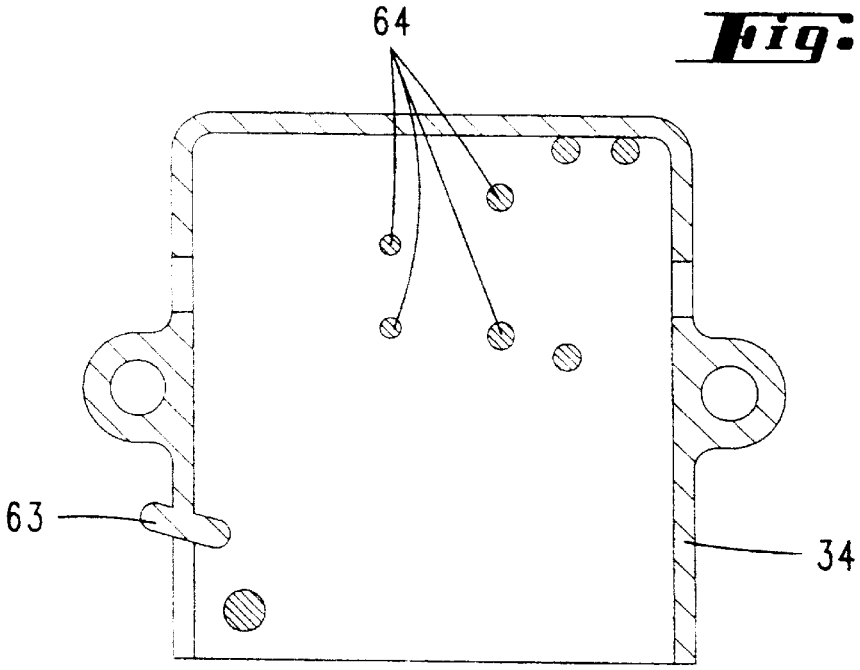
FIG. 9 shows an alternative configuration of the drive housing in a sectional illustration.

An alternative configuration of the drive box 34 is illustrated in FIG. 9. Here, in order to orient the position of the elements to be inserted—latching portion 36, locking portion 72 and spring element 42—pins 64 extending transversely are provided instead of integrally moulded webs.

The construction according to the invention ensures hands-free operation during the clamping of workpieces, including the clamping of prismatic workpieces. By simultaneous operation of the double pedal 56, the clamping jaw 3 is displaced uniformly along the two beams 2. Single-sided displacement of the clamping jaw 3 along a beam 2 can be carried out by operating only one pedal 57.

Changes and modifications can be made to the invention disclosed in the preferred embodiments and yet fall within the scope of the present invention. The invention is therefore to be limited only by the scope of the appended claims.

What is claimed is:

1. A workbench comprising:

two parallel beams;

a pair of clamping jaws disposed on and transverse relative to the two parallel beams, at least one of the clamping jaws being displaceable relative to the other clamping jaw;

a drive member associated with each of the beams that drive each respective jaw, wherein each of the drive members can be operated individually and independent of one another and also can be operated simultaneously;

a drive associated with each drive member that can be operated in an incremental step-by-step manner; and a pair of foot pedals, which are a double pedal, arranged adjacent one another below the two parallel beams which can be operated by a foot of a user to manipulate the drives.

2. The workbench according to claim 1, wherein each drive has a rod which is secured to the displaceable clamping jaw and which is displaced step by step by latching or clamping portions which can be displaced by a pedal to selectively pull and push a portion of the displaceable clamping jaw.

3. The workbench according to claim 1, wherein a clamping or latching drive that is part of the drive has a releasable reverse-pressure lock.

4. The workbench according to claim 3, wherein the reverse-pressure lock can be released by a reverse pedal operation.

5. The workbench according to claim 2, wherein each latching or clamping portion can be displaced by an operating lever.

6. The workbench according to claim 5, wherein, for each of the pair of clamping jaws, a respective operating lever is coupled to a respective pedal by a respective drive rod.

7. The workbench according to claim 5, wherein the operating lever enters into a driver opening in a locking portion to release the reverse-pressure lock.

8. The workbench according to claim 1, wherein the double pedal is disposed approximately at the centre of a cross member.

9. The workbench according to claim 1, wherein the double pedal is shaped like a gateway.

10. The workbench according to claim 6, wherein each respective drive rod is respectively pivoted on a respective pivoting lever, each respective lever being mounted on a shaft which can be rotated by each respective foot pedal, is disposed in the region of a supporting leg and extends in a U-shaped space in the supporting leg, which has a U-shaped cross-section.

11. The workbench according to claim 1, wherein for each of the pair of clamping jaws, a clamping or latching drive that is part of the drive is disposed approximately at the centre of the beam, underneath a bottom sliding bearing surface formed on top of a U-shaped beam section.

12. The workbench according to claim 1, wherein the other clamping jaw is mounted on the beams such that it can be moved by a spindle.

13. The workbench according to claim 1, wherein a beam section of each beam carrying the other clamping jaw is capable of being pivoted up into a 90° position relative to a remaining section of the beam.

14. The workbench according to claim 13, wherein the other clamping jaw can be engaged against a broad face of the displaceable clamping jaw when in the 90° position.

15. The workbench according to claim 10, wherein supporting legs of the workbench can be folded and, when in a position of use, are locked to the beams.

* * * * *